US006819291B1

(12) United States Patent
Lackey et al.

(10) Patent No.: US 6,819,291 B1
(45) Date of Patent: Nov. 16, 2004

(54) REDUCED-SIZE GPS ANTENNAS FOR ANTI-JAM ADAPTIVE PROCESSING

(76) Inventors: Raymond J. Lackey, 1260 Walnut Ave., Bohemia, NY (US) 11716; Alfred R. Lopez, 4 Sarina Dr., Commack, NY (US) 11725

( * ) Notice: Subject to any disclaimer, the term of this patent is extended or adjusted under 35 U.S.C. 154(b) by 0 days.

(21) Appl. No.: 10/452,530

(22) Filed: Jun. 2, 2003

(51) Int. Cl.[7] ..... H01Q 1/38

(52) U.S. Cl. ..... 343/700 MS; 343/853; 342/375

(58) Field of Search ..... 343/700 MS, 754, 343/844, 853; 342/375

(56) References Cited

U.S. PATENT DOCUMENTS 3,045,237 A * 7/1962 Marston ..... 343/754
3,503,075 A * 3/1970 Gerst ..... 342/371
3,811,127 A 5/1974 Griffee, et al. ..... 343/705
4,962,383 A * 10/1990 Tresselt ..... 343/700 MS
5,243,358 A * 9/1993 Sanford et al. ..... 343/836
5,327,147 A * 7/1994 Caille et al. ..... 343/700 MS
5,521,610 A 5/1996 Rodal ..... 343/797
5,966,102 A 10/1999 Runyon ..... 343/820
2003/0218575 A1 * 11/2003 Walker et al. ..... 343/853

* cited by examiner

*Primary Examiner*—Tan Ho

(57) ABSTRACT

A reduced-size GPS antenna with anti-jam capabilities includes eight inclined monopole elements making available a primary and seven auxiliary antenna patterns usable with multi-pattern adaptive processing for anti-jam operation. An excitation network coupled to the eight monopole elements can be configured to provide the eight antenna patterns having quadrature characteristics with low mutual coupling. Bent monopoles or other elements may also be utilized. With availability of the primary and auxiliary patterns, multi-pattern adaptive processing can be employed during air-borne operations to actively provide reduced-gain pattern notches or nulls to track incident angles of interference or jamming signals. In other embodiments selected combinations of less than all of the eight antenna patterns or other patterns may be employed.

21 Claims, 10 Drawing Sheets

| Mode | Phase Excitation (Degrees) Element Number | | | | | | | |
|---|---|---|---|---|---|---|---|---|
| | 1 | 2 | 3 | 4 | 5 | 6 | 7 | 8 |
| I | 0 | 45 | 90 | 135 | 180 | 225 | 270 | 315 |
| II | 0 | -45 | -90 | -135 | -180 | -225 | -270 | -315 |
| III | 0 | 90 | 180 | 270 | 0 | 90 | 180 | 270 |
| IV | 0 | -90 | -180 | -270 | 0 | -90 | -180 | -270 |
| V | 0 | 135 | 270 | 45 | 180 | 315 | 90 | 225 |
| VI | 0 | -135 | -270 | -45 | -180 | -315 | -90 | -225 |
| VII | 0 | 180 | 0 | 180 | 0 | 180 | 0 | 180 |
| VIII | 0 | 0 | 0 | 0 | 0 | 0 | 0 | 0 |

REDUCED-SIZE GPS ANTENNAS FOR ANTI-JAM ADAPTIVE PROCESSING

SEQUENCE LISTING (Not Applicable)

RELATED APPLICATIONS (Not Applicable)

FEDERALLY SPONSORED RESEARCH (Not Applicable)

BACKGROUND OF THE INVENTION

This invention relates to airborne antennas and, more particularly, to such antennas providing multiple beam excitation usable with anti-jam adaptive processing to suppress jamming and interference.

A variety of antennas have been made available for reception of Global Positioning System (GPS) signals for navigational and other purposes. A more critical objective than the mere capability to receive such signals, is the objective of enabling reception in the presence of interference or jamming signals. Interference may be the unintended result of reception of signals radiated for some purpose unrelated to GPS operations. Jamming, on the other hand, may involve signals intentionally transmitted for the purpose of obstructing reception of GPS signals. In airborne operations which are dependent upon use of GPS signals, deleterious effects of interference or jamming may be particularly disruptive.

For reception via a fixed-position antenna in the presence of interference signals incident from a fixed azimuth, for example, a reduced-gain antenna pattern notch aligned to suppress reception at the appropriate azimuth may be employed as an effective solution. However, for airborne operations a more complex solution is required. With an aircraft and its antenna operable in a variety of geographical locations and conditions, with constantly changing azimuth orientation during flight, interference or jamming signals may be incident from any azimuth and with constantly changing azimuth. At the same time, maneuvers such as banked turns of an aircraft, for example, tilt the aircraft and its antenna so that the interference or jamming signals may be incident from different and changing elevation angles.

A variety of adaptive processing techniques have previously been described. Such techniques typically provide an anti-jam capability based on provision of reduced-gain antenna pattern notches and alignment of such notches at the incident azimuth of undesired incoming signals. However, to enable practical employment of such techniques for reception of GPS signals under critical airborne operations, reliable, low-profile antennas providing a multi-beam capability suitable for anti-jam application are required.

Examples of prior antennas meeting most of these objectives include those provided in U.S. patent application Ser. No. 09/789,467, filed Feb. 21, 2001, and having a common assignee with the present application. That application describes, in particular, a GPS antenna including four bent monopoles in combination with four slot elements to provide primary and auxiliary antenna patterns usable for aircraft anti-jam applications.

Airborne applications may include large aircraft, smaller fighter and drone aircraft where small antenna size is important, and smaller objects such as missiles, guided bombs and other projectiles. In the latter categories of applications size, weight, cost and complexity become increasingly important, along with antenna anti-jam operational capabilities. Prior types of GPS antennas have typically not fully met overall objectives of small size and low weight, cost and complexity, with concurrent high performance and multiple auxiliary antenna patterns usable for anti-jam adaptive processing for such applications.

Accordingly, objects of the present invention are to provide new and improved aircraft antennas having one or more of the following characteristics and capabilities:

- low-profile configuration of eight monopole elements in circular array;
- eight elements with eight beam excitation capability;
- omnidirectional circularly-polarized principal beam;
- seven selectively usable auxiliary beams;
- full hemispherical beam coverage;
- multiple elements for omnidirectional and other coverage;
- small-size, low-profile implementation;
- high-performance, high-reliability design;
- usable in a variety of beam configurations for anti-jam applications; and
- multiple pattern excitation suitable for adaptive processing anti-jam operation.

SUMMARY OF THE INVENTION

In accordance with the invention, an eight-element GPS antenna, usable with multi-pattern adaptive processing for anti jam operation includes a ground plane portion, eight monopole elements positioned above the ground plane portion and an excitation network coupled to the monopole elements. The excitation network is configured to provide output signals representative of each of the following antenna patterns;

(i) 45 degree counter-clockwise (CCW) progressive phase excitation of the monopole elements to produce a first circularly-polarized omnidirectional antenna pattern;

(ii) 45 degree clockwise (CW) progressive phase excitation of the monopole elements to produce a second circularly polarized omnidirectional antenna pattern;

(iii) 90 degree CCW progressive phase (PP) excitation of the monopole elements to produce a 90 degree CCW PP antenna pattern;

(iv) 90 degree CW progressive phase excitation of the monopole elements to produce a 90 degree CW PP antenna pattern;

(v) 135 degree CCW progressive phase excitation of the monopole elements to produce a 135 degree CCW PP antenna pattern;

(vi) 135 degree CW progressive phase excitation of the monopole elements to produce a 135 degree CW PP antenna pattern;

(vii) 180 degree progressive phase excitation of the monopole elements to produce an eight-lobe antenna pattern; and (viii) same phase excitation of the monopole elements to produce a uniform phase omnidirectional antenna pattern.

In other embodiments, antennas may be arranged to utilize only some of the above antenna patterns in different selected combinations and may include other patterns.

For a better understanding of the invention, together with other and further objects, reference is made to the accompanying drawings and the scope of the invention will be pointed out in the accompanying claims.

DESCRIPTION OF THE INVENTION

Figure 1:
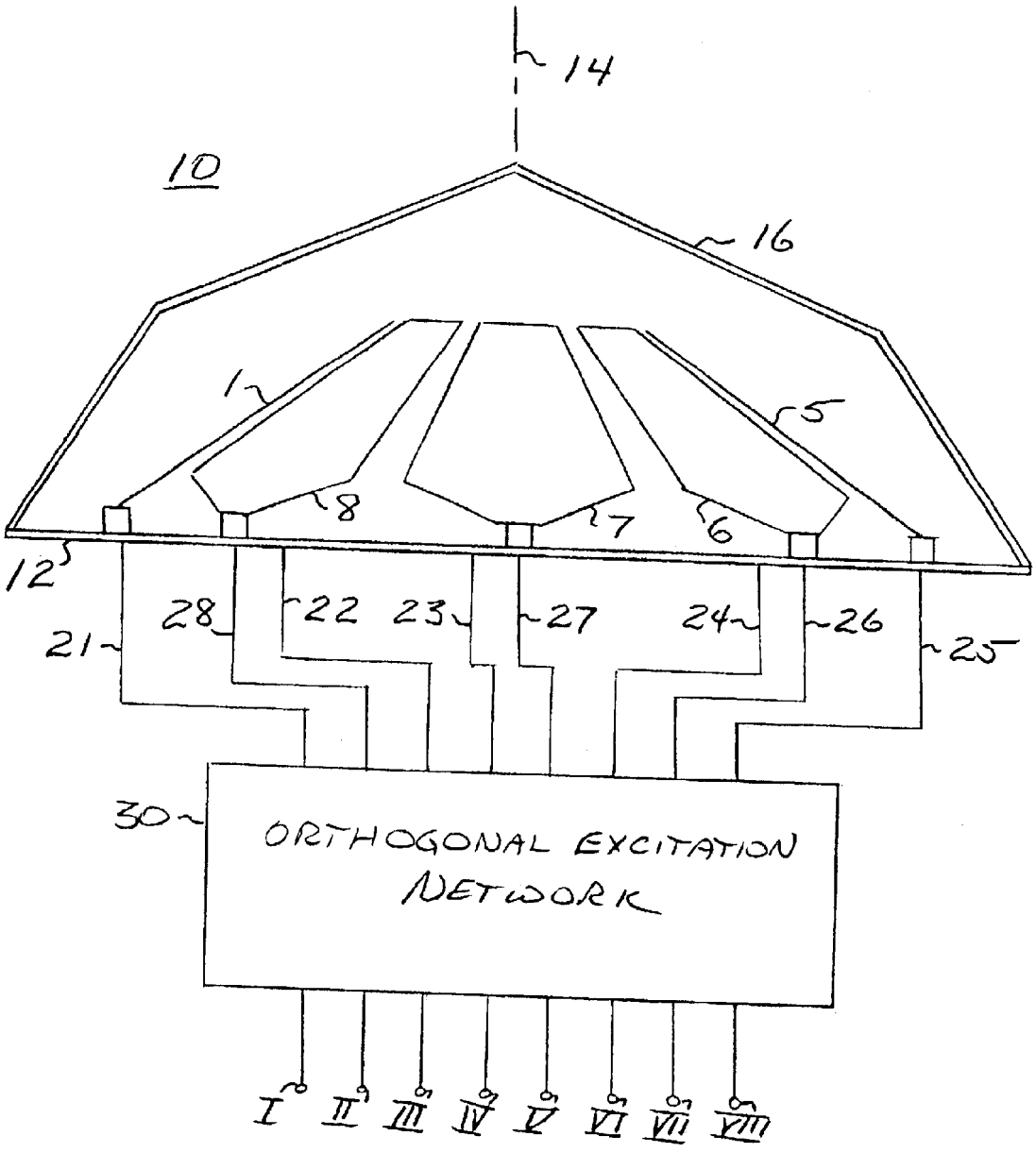
FIG. 1 illustrates an eight-element GPS antenna including eight inclined monopole elements and usable with multi-pattern adaptive processing for anti-jam operation.

FIG. 1 is a side view of an eight-element GPS antenna usable with multi-pattern adaptive processing for anti jam operation. For dual-band GPS reception, with anti-jam processing for critical airborne applications, the FIG. 1 antenna may include monopole radiating elements only about one inch high, in an array antenna with overall array dimensions of approximately 3.75 inches in diameter by less than two inches in height with inclusion of a protective radome. As will be described, this antenna can be arranged to provide a principal omnidirectional circularly-polarized antenna pattern, with seven additional auxiliary patterns having differing characteristics usable for multi-pattern adaptive processing. Thus, this performance can be achieved with a reduced-size array having an array diameter of the order of one-half wavelength at a frequency in the GPS operating band.

Figures 2, 3:
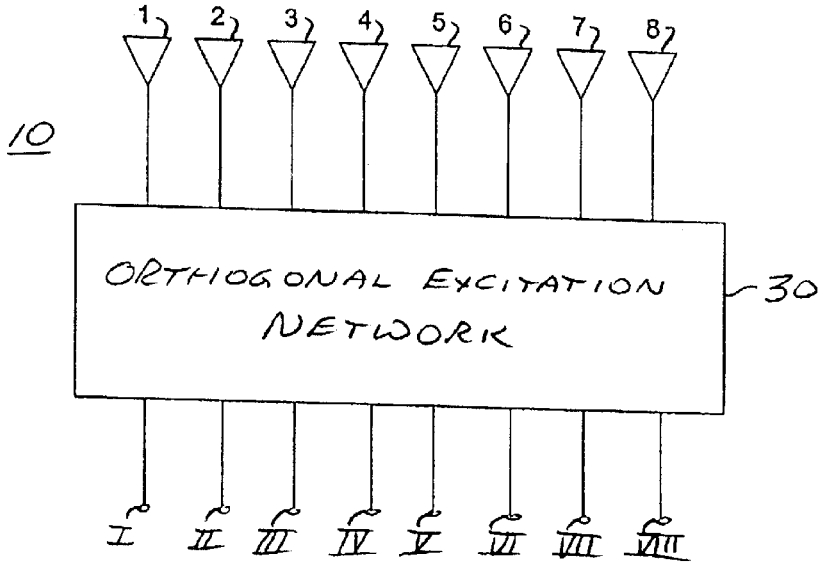
FIG. 2 is a simplified block diagram of the FIG. 1 antenna showing all eight radiating elements.
FIG. 3 provides relative phase excitations of the eight element of FIGS. 1 and 2 for eight excitation modes I through VIII.

The FIG. 1 antenna 10 includes a circular array of eight inclined monopole elements 1–8 positioned above a ground plane portion 12 and arrayed around an axis 14 shown with vertical alignment. In this view only monopole elements 1, 5, 6, 7 and 8 are visible, elements 2, 3 and 4 being on the far side of the circular array and obscured from view. FIG. 2 provides representations of all eight elements, without representation of the spatial aspects of the circular array configuration as shown in FIG. 1. Included in FIG. 1 is a radome 16, shown transparent, which may be of any shape and construction suitable for antenna operation with appropriate structural protection.

The FIG. 1 antenna also includes an orthogonal excitation network 30 coupled to each monopole element via transmission lines 21–28. Network 30 is configured to provide excitation of the following modes or beams I–VIII via the correspondingly labeled ports I–VIII as included in FIGS. 1 and 2.

(i) Mode I: 45 degree counter-clockwise (CCW) progressive phase excitation of the monopole elements to produce a first circularly-polarized omnidirectional antenna pattern.

(ii) Mode II: 45 degree clockwise (CW) progressive phase excitation of the monopole elements to produce a second circularly polarized omnidirectional antenna pattern.

(iii) Mode III: 90 degree CCW progressive phase (PP) excitation of the monopole elements to produce a 90 degree CCW PP antenna pattern.

(iv) Mode IV: 90 degree CW progressive phase excitation of the monopole elements to produce a 90 degree CW PP antenna pattern.

(v) Mode V: 135 degree CCW progressive phase excitation of the monopole elements to produce a 135 degree CCW PP antenna pattern.

(vi) Mode VI: 135 degree CW progressive phase excitation of the monopole elements to produce a 135 degree CW PP antenna pattern.

(vii) Mode VII: 180 degree progressive phase excitation of the monopole elements to produce an eight-lobe antenna pattern.

(viii) Mode VIII: same phase excitation of the monopole elements to produce a uniform phase omnidirectional antenna pattern As to mode I, for example, the above characterization indicates that the eight monopole elements are excited by equal amplitude signals with the phase of signals at each successive one of elements 1–8 having a relationship of −45 degrees relative to signals at the preceding element. It will be appreciated that antenna components generally provide reciprocal performance, so that while an antenna may be intended for reception of signals, description may be in terms of element excitation by the excitation network. Thus, during reception of GPS signals, output signals representative of the antenna pattern of mode I will be provided at port I. In other configurations pursuant to the invention, other excitation modes, different combinations of modes or fewer modes may be utilized.

Orthogonal excitation network 30 is effective to provide eight modes each characterized by orthogonal excitation and low mutual coupling properties relative to the other modes. Known types of Butler beam forming networks provide such properties and, using established techniques, may be designed to combine GPS signals received by the eight elements 1–8 to provide the desired mode output signals at ports I–VIII as set out above. FIG. 3 provides the relative phase excitation at each of monopole elements 1–8 as appropriate to provide the mode I–VI outputs at the respective ports I–VIII of FIGS. 1 and 2. A basic form of Butler network providing eight orthogonal fan type beams is shown and described at page 261 of Microwave Scanning Antennas, R. C. Hansen, Academic Press, NY, 1966. With an understanding of the invention, orthogonal excitation network 30 providing the element excitations as set out in FIG. 3 can be provided by skilled persons with application of current antenna design techniques.

As shown in FIG. 1, each radiating element is an identical inclined monopole element of planar tapered configuration supported at its lower end having a feed connection and positioned at an angle of approximately 35 degrees to the ground plane portion, in this embodiment. Each element is thus inclined at an acute angle to a principal surface of ground plane portion 12 (e.g., its upper surface in FIG. 1). In other configurations, for particular applications different forms of monopole elements may be provided by skilled persons. For example, in the embodiment to be described with reference to FIG. 5, bent monopole elements having successive portions perpendicular and parallel to a ground plane are utilized. Each monopole element may be formed of thin conductive sheet metal, metallized plastic, or other suitable material. As shown in FIG. 1, each monopole element is supported at the midpoint of its lower end at a support point at or associated with a connector or connection point. Each such element may thus be attached to the center conductor of a coaxial connector which mates with a connector mounted through a hole in the ground plane portion, with that mounted connector providing connection to one of the lines or coaxial cables 21–28 coupled to network 30. In FIG. 1, the connection points for cables 22, 23 and 24 are directly behind the connection points for cables 28, 27 and 26, respectively. Cables 22, 23 and 24 have been horizontally offset in FIG. 1 for clarity of presentation. With this configuration a monopole element can be installed in an antenna by merely mating its coaxial connector with the appropriate connector mounted through the ground plane portion 12 of FIG. 1. Structural stability for this form of construction can be provided by inclusion of suitably formed pieces of low dielectric constant foam or other suitable devices positioned to support the inclined monopole elements in the FIG. 1 arrangement. Other types and configurations of elements can be provided by skilled persons for particular implementations of the invention. Radome 16 may be formed of suitable dielectric or other material in appropriate form and strength to provide desired physical protection for the monopole elements, while being transmissive for signals in GPS frequency bands.

Figure 4:
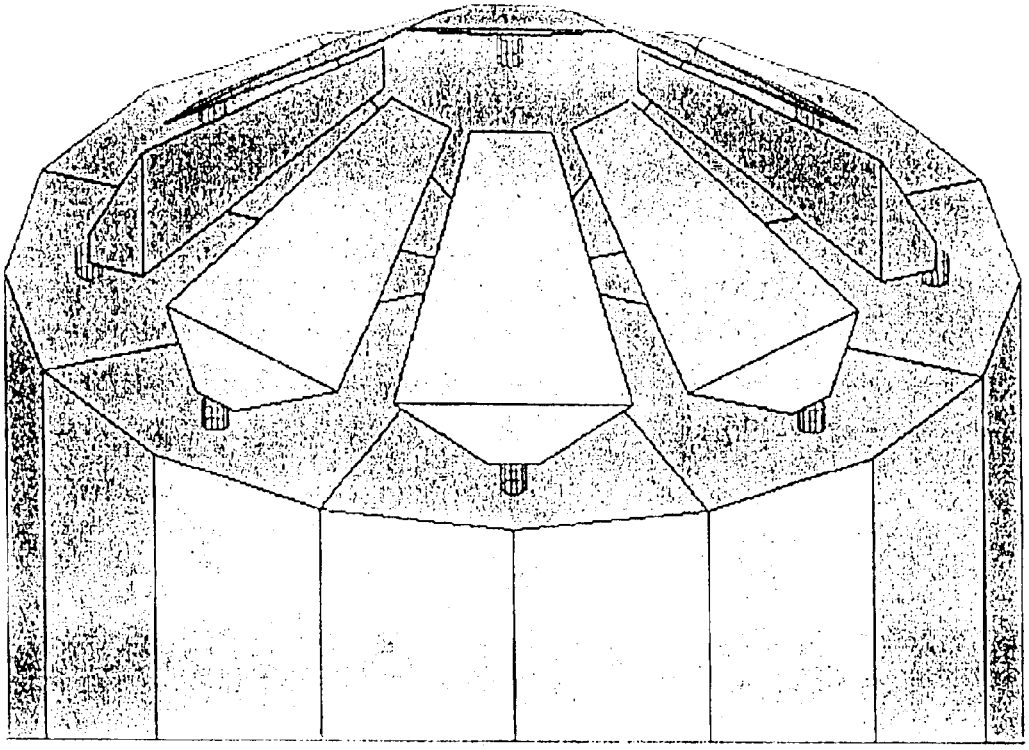
FIG. 4 is an angled plan view of the FIG. 1 antenna mounted on a cylindrical object.

Referring now to FIG. 4, it provides an angled plan view of the FIG. 1 antenna mounted on the end of a cylindrical object, which could represent the nose of an aircraft or other airborne vehicle or device, which may be configured for powered flight, gliding free fall, etc. In other applications, such an antenna may be mounted on the upper surface of an airliner or in any appropriate position and alignment. In this illustrated configuration, each monopole element is a thin planar element inclined at an acute angle and, as shown, has a free end extending inward toward another element (i.e., the element directly across from it in the circular array). The term "airborne" is used in its dictionary sense of carried by or through the air or space.

Figure 5:
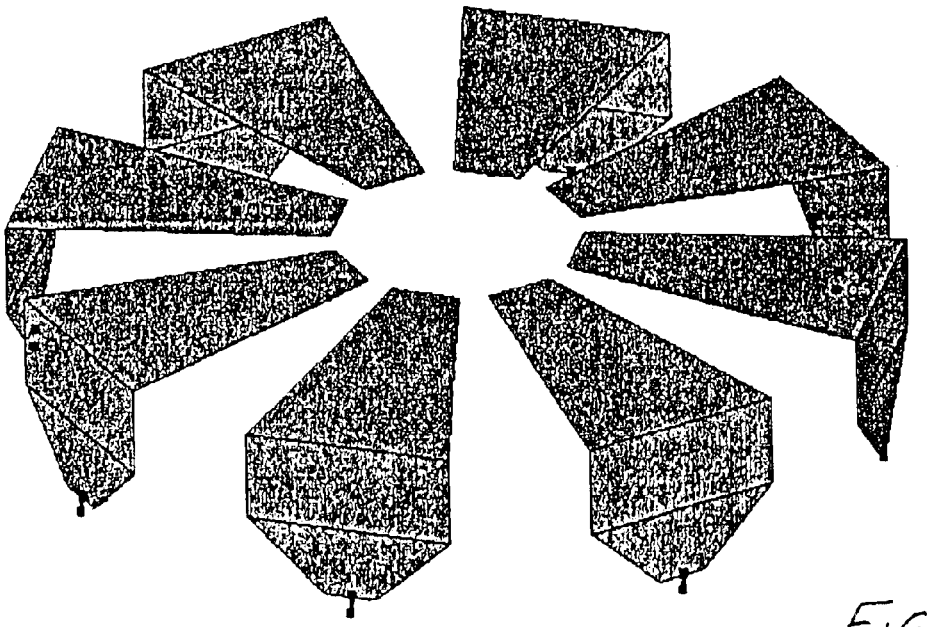
FIG. 5 shows a second embodiment of the eight monopole array of the FIG. 1 antenna.

FIG. 5 illustrates a second embodiment of eight monopole elements positioned in a circular array. In this example, each element has the same general physical form as the elements of FIG. 1, except that each element is configured to extend nominally perpendicular to a ground plane (not shown) to a 90 degree bend and then to extend inwardly nominally parallel to such ground plane, as shown. Dimensions of a FIG. 5 antenna for dual-band GPS operation may approximate 0.9 inches in height and 4.0 inches in diameter for the eight elements. A variety of other radiating element designs can be provided by skilled persons having an understanding of the invention. The term "nominally" is defined as being within plus or minus 15 degrees or 15 percent of a stated value or relationship.

Figure 6:
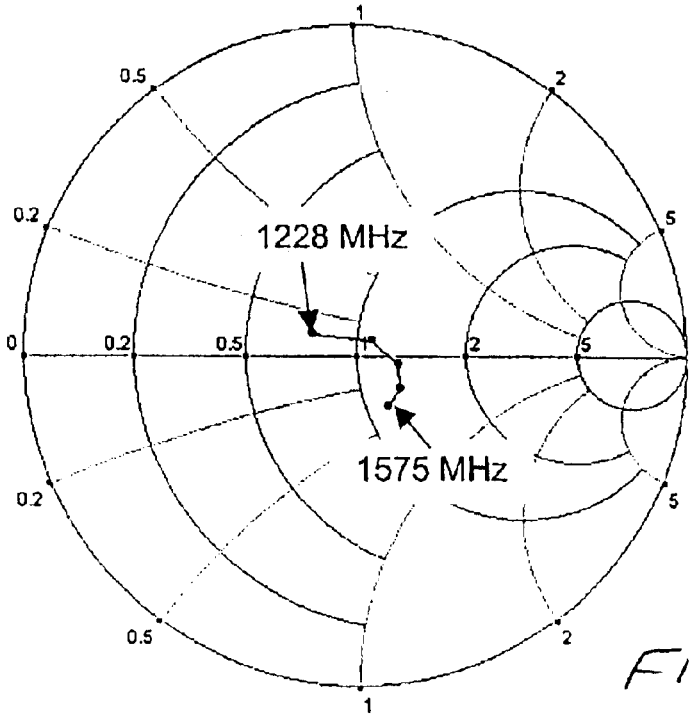
FIGS. 6 and 7 are computed impedance diagrams for the FIG. 1 antenna in isolated and ground plane mounted configurations, respectively.
Figure 7:
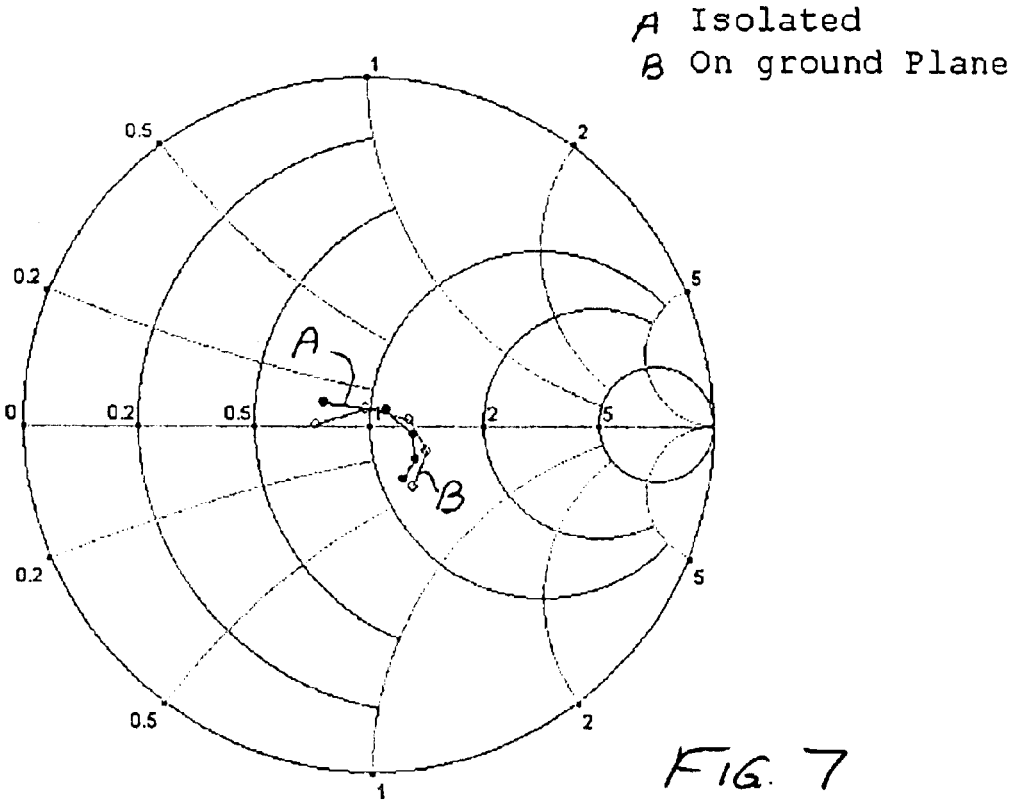
Figure 8:
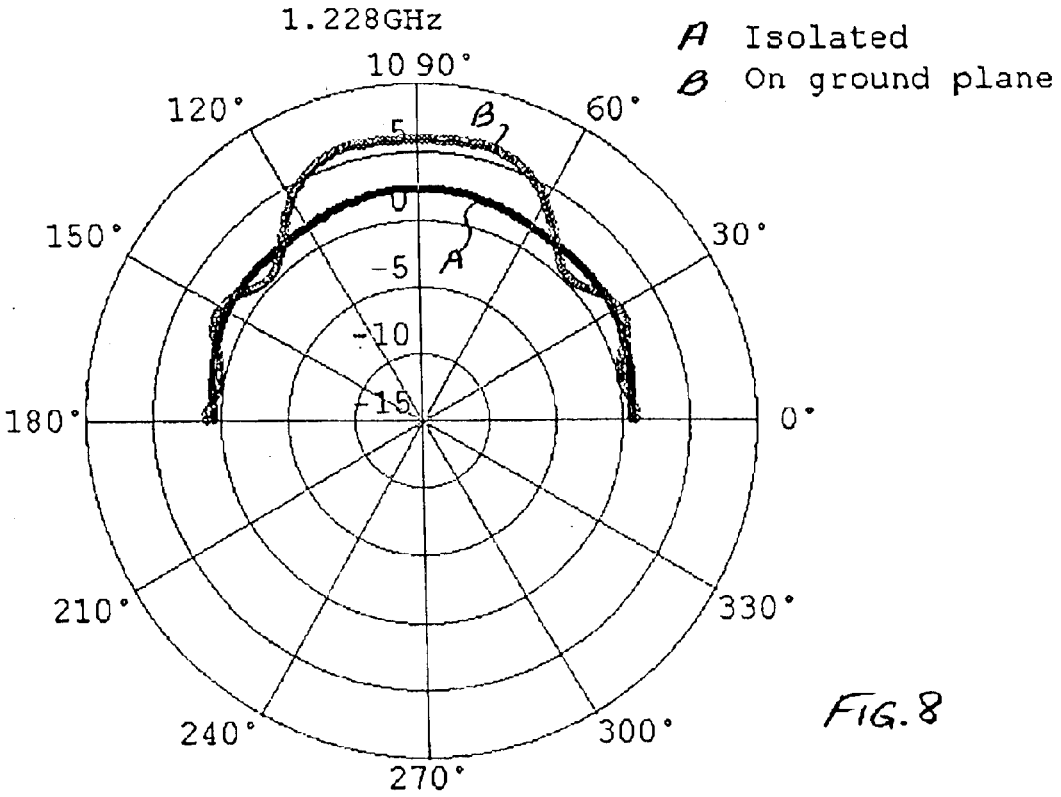
FIGS. 8 and 9 are computed radiation pattern diagrams for the FIG. 1 antenna at different GPS frequencies.
Figure 9:
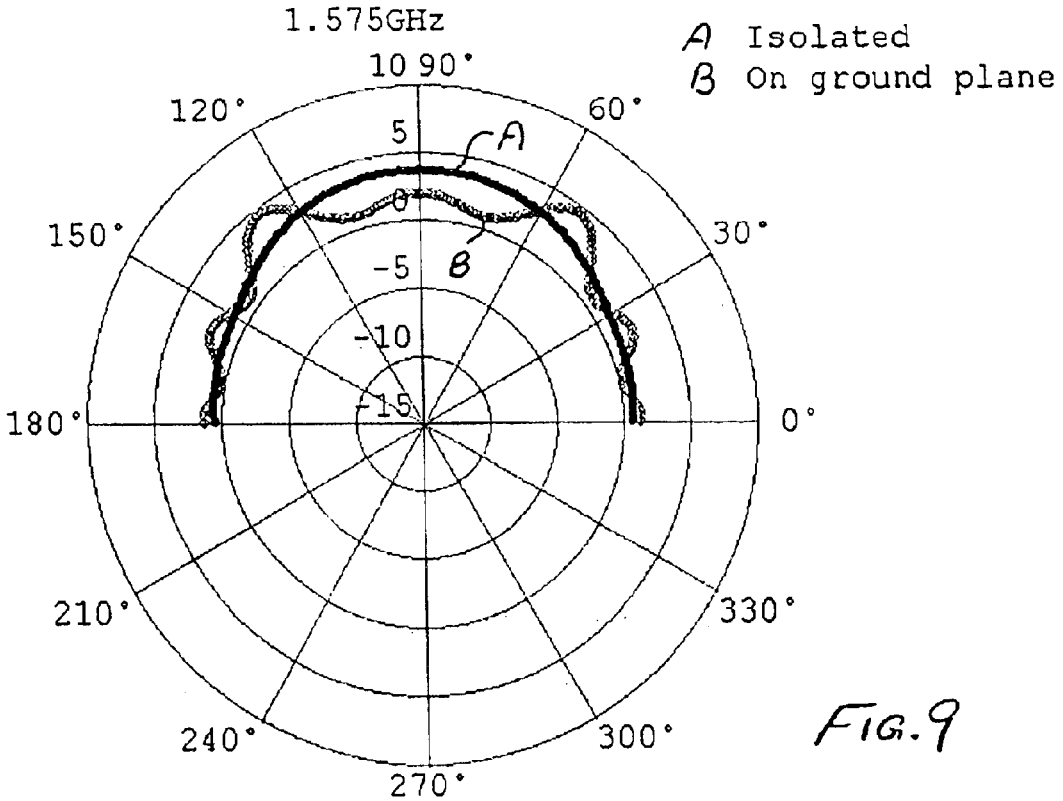

FIGS. 6 and 7 show computed impedance characteristics for the antenna of FIGS. 1 and 4 with the antenna isolated (FIGS. 6 and 7) and with the antenna mounted on a perfectly conducting ground plane (FIG. 7). This data shows a maximum VSWR of 1.4 for operation over a dual-band GPS frequency range of 1228 to 1575 MHz. FIGS. 8 and 9 show computed radiation patterns for such antenna at 1.228 GHz and 1.575 GHz, respectively, for both isolated and ground plane mounted operation.

Figure 10:
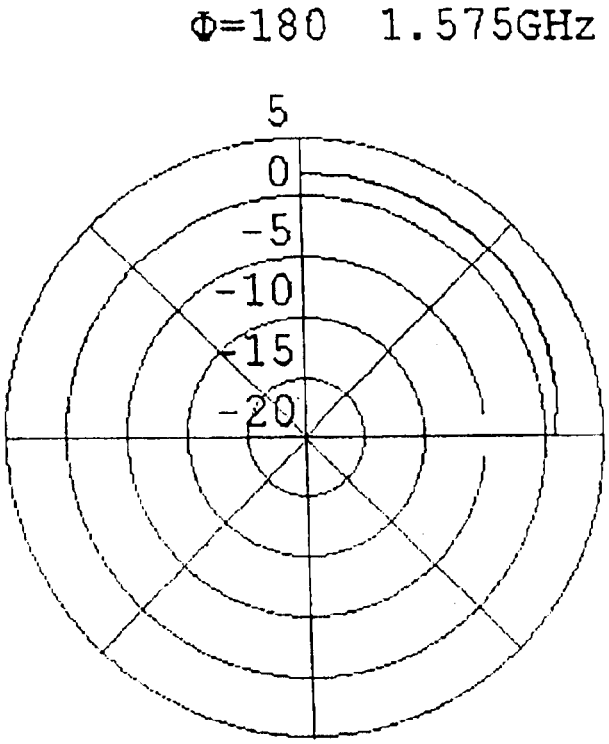
FIGS. 10, 11, 12, 13, 14, 15, 16, 17, 18 and 19 show computed antenna patterns, elevation or azimuth, for representative modes of the eight excitation modes with use of a described type of monopole array.
Figure 11:
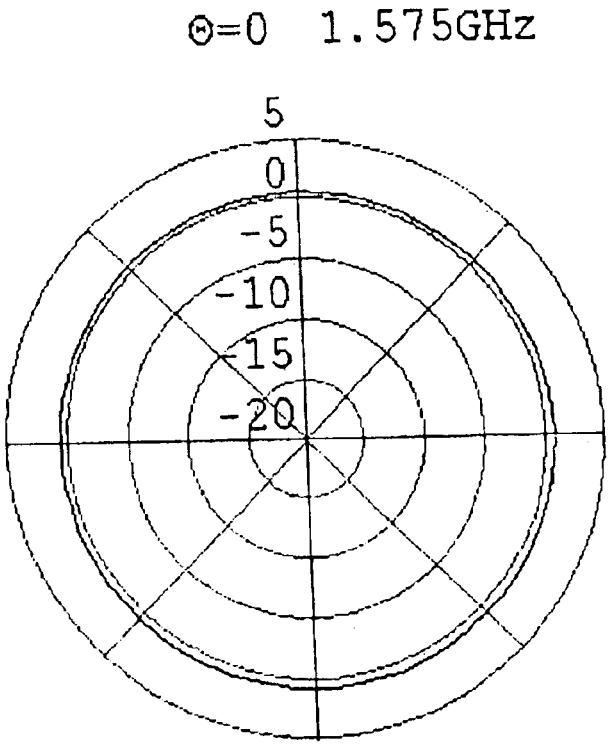
Figure 12:
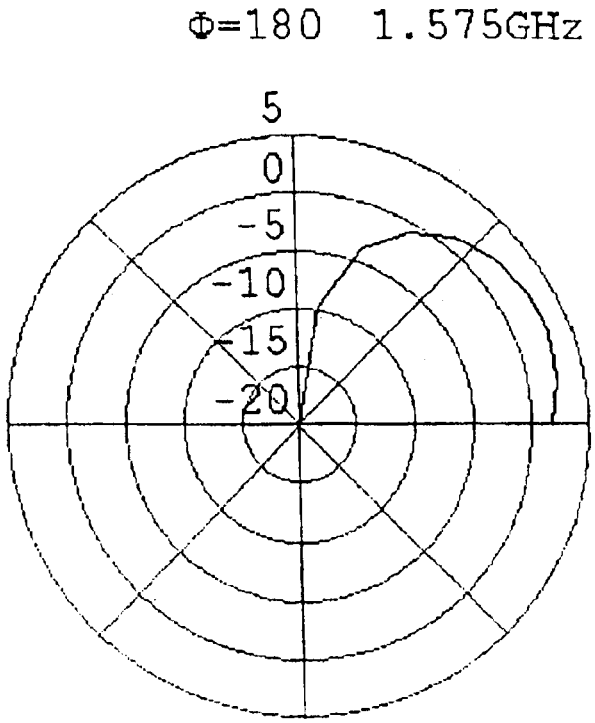
Figure 13:
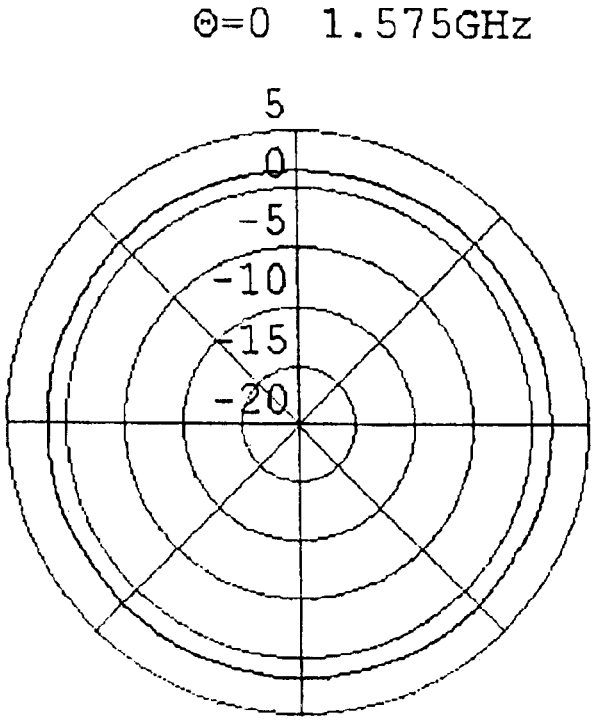
Figure 14:
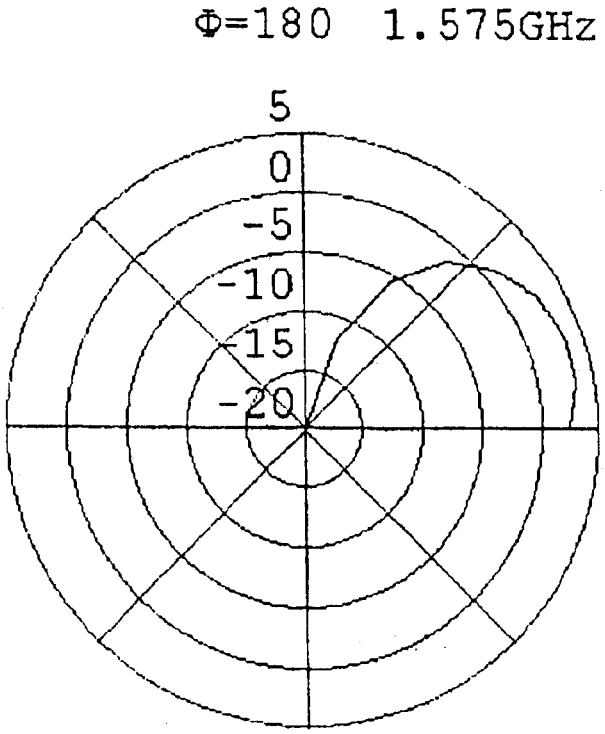
Figure 15:
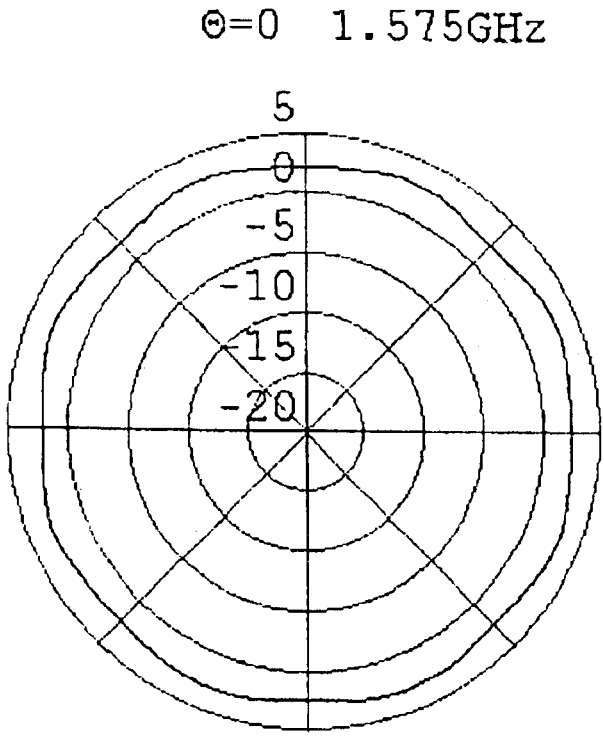
Figure 16:
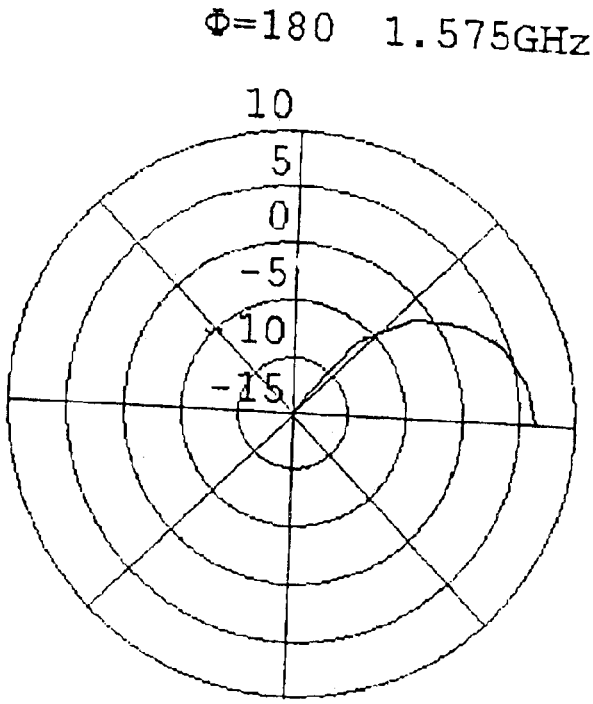
Figure 17:
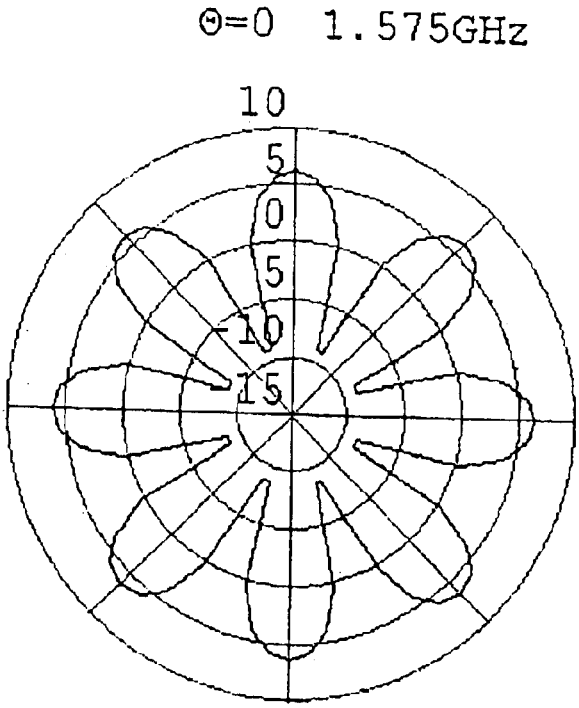
Figure 18:
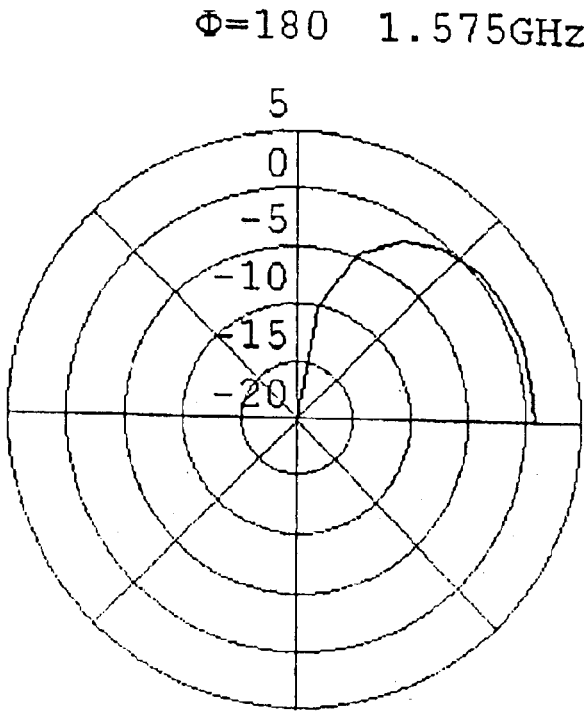
Figure 19:
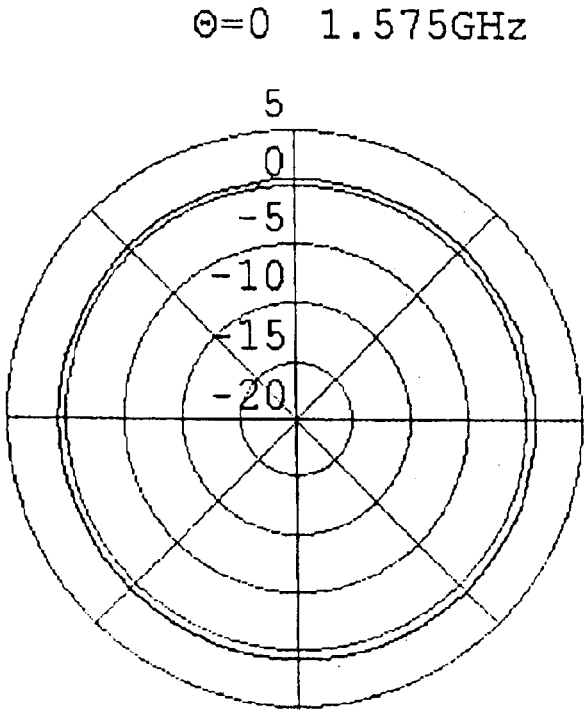

FIGS. 10–19 provide representative computed antenna patterns with use of a type of monopole described above. The data shows directive gain at 1.575 GHz (the radial scale represents gain in dB). Performance at 1.575 GHz also approximates performance at 1.228 GHz. These figures provide such patterns for the following modes:

FIGS. 10 and 11, mode I, elevation and azimuth, respectively;

FIGS. 12 and 13, mode III, elevation and azimuth, respectively;

FIGS. 14 and 15, mode V, elevation and azimuth, respectively;

FIGS. 16 and 17, mode VII, elevation and azimuth, respectively; and FIGS. 18 and 19, mode VIII, elevation and azimuth, respectively.

Operationally, the inclined monopole elements of the FIG. 1 antenna provide enhanced vertical radiation characteristics, with the desired horizontal coverage. Thus, in mode I, for example, the right-hand circularly polarized (RHCP) antenna pattern provides omnidirectional coverage in azimuth, as well as vertical radiation characteristics enhancing provision of a hemispherical antenna pattern with elevation coverage from horizontal to vertical (0 to 90 degrees in elevation). The antenna alignment for hemispherical coverage as stated relates to FIG. 1 with axis 14 vertical, however, in use the antenna may be employed with any suitable fixed alignment or with alignment varying during flight.

With availability of the eight antenna patterns as described, the RCHP omni pattern (mode I) can be utilized as the primary antenna pattern for reception of GPS signals. With the employment of the inclined monopole elements as shown, this pattern provides hemispherical coverage with omnidirectional coverage in azimuth, as noted. The remaining seven antenna patterns (i.e., the auxiliary patterns) may be employed pursuant to known techniques of adaptive processing to actively combine one or more of such patterns with the primary RHCP pattern in order to form, orient and steer reduced-gain antenna pattern notches to suppress reception of interference and jamming signals. Using such multi-pattern adaptive processing techniques, the presence of interference and jamming signals can be constantly monitored and suppression actively implemented during flight of an airborne vehicle, for example. With the eight patterns available from the present antenna, skilled persons will be enabled to implement a variety of anti-jam signal processing techniques as appropriate to particular implementations and applications of antennas employing the invention. For example, on an active continuing basis one or more reduced-gain antenna pattern nulls or notches can be steered to or provided at the fixed or changing azimuth or azimuths appropriate to suppress reception of incoming interference or jamming signals which could interfere with or prevent reliable reception of GPS signals, during airborne operations.

As described, the mode I pattern providing omnidirectional coverage, with circular polarization and hemispherical coverage in elevation, can be employed as the primary beam for airborne reception of GPS signals. Depending upon the application and implementation, any one or more of the remaining seven antenna patterns, as described, may be made available for use as auxiliary beams in combinations to provide notches or nulls when and where needed, via application of adaptive processing techniques.

While there have been described the currently preferred embodiments of the invention, those skilled in the art will recognize that other and further modifications may be made without departing from the invention and it is intended to claim all modifications and variations as fall within the scope of the invention.

What is claimed is:

1. An eight-element GPS antenna, usable with multi-pattern adaptive processing for anti-jam operation, comprising:

a ground plane portion;

eight monopole elements positioned above said ground plane portion and arrayed around an axis; and an excitation network coupled to said monopole elements, the excitation network configured to provide output signals representative of each of the following antenna patterns:

(i) 45 degree counter-clockwise (CCW) progressive phase excitation of the monopole elements to produce a first circularly-polarized omnidirectional antenna pattern;

(ii) 45 degree clockwise (CW) progressive phase excitation of the monopole elements to produce a second circularly polarized omnidirectional antenna pattern;

(iii) 90 degree CCW progressive phase (PP) excitation of the monopole elements to produce a 90 degree CCW PP antenna pattern;

(iv) 90 degree CW progressive phase excitation of the monopole elements to produce a 90 degree CW PP antenna pattern;

(v) 135 degree CCW progressive phase excitation of the monopole elements to produce a 135 degree CCW PP antenna pattern;

(vi) 135 degree CW progressive phase excitation of the monopole elements to produce a 135 degree CW PP antenna pattern;

(vii) 180 degree progressive phase excitation of the monopole elements to produce an eight-lobe antenna pattern; and (viii) same phase excitation of the monopole elements to produce a uniform phase omnidirectional antenna pattern.

2. A GPS antenna as in claim 1, wherein said excitation network is configured to provide signals representative of each of said antenna patterns upon reception of GPS signals.

3. A GPS antenna as in claim 1, wherein said excitation network is positioned below said ground plane portion.

4. A GPS antenna as in claim 1, wherein each said monopole element is inclined at an angle relative to a principal surface of said ground plane portion.

5. A GPS antenna as in claim 1, wherein each said monopole element is a thin planar element inclined at an angle of nominally 35 degrees relative to a principal surface of said ground plane portion.

6. A GPS antenna as in claim 1, wherein said monopole elements are arrayed nominally in a circle, with each said element inclined at an acute angle and having a free end extending inward toward said axis.

7. A GPS antenna as in claim 1, wherein each said monopole element has a bend between a first portion extending nominally perpendicular to said ground plane portion and a second portion extending nominally parallel to said ground plane portion.

8. A GPS antenna as in claim 1, wherein said excitation network is a Butler type beam forming network configured for excitation of eight antenna patterns.

9. A GPS antenna as in claim 1, additionally comprising:

eight output ports coupled to said excitation network, with each output port arranged to provide output signals representative of a different one of said antenna patterns.

10. A GPS antenna, comprising:

a ground plane portion;

eight radiating elements positioned above said ground plane portion in a nominally circular array; and, an excitation network coupled to said radiating elements and configured to make available output signals representative of:

45 degree progressive phase excitation of the radiating elements to produce a first circularly-polarized omnidirectional antenna pattern;

and to additionally make available output signals representative of at least two of the following auxiliary excitations:

(i) 90 degree counter-clockwise (CCW) progressive phase (PP) excitation of the radiating elements to produce a 90 degree CCW PP antenna pattern;

(ii) 90 degree clockwise (CW) progressive phase excitation of the radiating elements to produce a 90 degree CW PP antenna pattern;

(iii) 135 degree CCW progressive phase excitation of the radiating elements to produce a 135 degree CCW PP antenna pattern; and (iv) 135 degree CW progressive phase excitation of the radiating elements to produce a 135 degree CW PP antenna pattern.

11. A GPS antenna as in claim 10, wherein said excitation network is configured to additionally make available output signals representative of:

(v) 180 degree progressive phase excitation of the monopole elements to produce an eight-lobe antenna pattern.

12. A GPS antenna as in claim 10, wherein said excitation network is configured to additionally make available output signals representative of:

(v) same phase excitation of the monopole elements to produce a uniform phase omnidirectional antenna pattern.

13. A GPS antenna as in claim 10, wherein each said radiating element is a monopole element inclined at an acute angle relative to a principal surface of said ground plane portion.

14. A GPS antenna as in claim 10, wherein said radiating elements are thin planar monopole elements each inclined at an acute angle and having a free end extending inward toward another of said elements.

15. A GPS antenna as in claim 10, wherein each said radiating element is a monopole element having a bend between a first portion extending nominally perpendicular to said ground plane portion and a second portion extending nominally parallel to said ground plane portion.

16. A GPS antenna, comprising:

a ground plane portion;

eight monopole elements positioned above said ground plane in a nominally circular array around an axis; and an excitation network coupled to each said monopole element and configured to make available output signals representative of:

excitation of all said monopole elements to produce at least one primary antenna pattern for GPS reception; and a plurality of auxiliary antenna patterns usable with adaptive processing to provide anti-jam GPS operation, each said auxiliary antenna pattern having at least one pattern characteristic differing from each said primary antenna pattern and each other auxiliary antenna pattern.

17. A GPS antenna as in claim 16, wherein said excitation network is configured to provide an auxiliary antenna pattern via 90 degree progressive phase (PP) excitation of the monopole elements, to produce a 90 degree PP antenna pattern.

18. A GPS antenna as in claim 16, wherein said excitation network is configured to provide an auxiliary antenna pattern via 135 degree progressive phase (PP) excitation of the monopole elements, to produce a 135 degree PP antenna pattern.

19. A GPS antenna as in claim 16, wherein each said monopole element is inclined at an acute angle relative to a principal surface of said ground plane portion.

20. A GPS antenna as in claim 16, wherein each said monopole element is a thin planar element inclined at an acute angle and has a free end extending inward toward another of said elements.

21. A GPS antenna as in claim 16, wherein each said monopole element has a bend between a first portion extending nominally perpendicular to said ground plane portion and a second portion extending nominally parallel to said ground plane portion.

* * * * *